US005547016A

United States Patent [19]

Fassbinder

[11] Patent Number: 5,547,016

[45] Date of Patent: Aug. 20, 1996

[54] METHOD FOR HEATING A GAS IN A REGENERATOR

[75] Inventor: Hans-Georg Fassbinder, Sulzbach-Rosenberg, Germany

[73] Assignee: L'Air Liquide, Societe Anonyme Pour L'Etude et L'Exploitation des Procedes Georges Claude, Paris Cedex, France

[21] Appl. No.: 232,064

[22] PCT Filed: Oct. 19, 1993

[86] PCT No.: PCT/FR93/01025

§ 371 Date: Apr. 28, 1994

§ 102(e) Date: Apr. 28, 1994

[87] PCT Pub. No.: WO94/10519

PCT Pub. Date: May 11, 1994

[30] Foreign Application Priority Data

Oct. 29, 1992 [DE] Germany ..... 42 36 619.4

[51] Int. Cl.[6] ..... F23L 15/02

[52] U.S. Cl. ..... 165/9.4; 165/9.1; 165/4

[58] Field of Search ..... 165/9.4, 9.1, 10, 165/4; 431/354

[56] References Cited

U.S. PATENT DOCUMENTS

| | | | |
|---|---|---|---|
| 1,940,371 | 12/1933 | Royster | 165/4 |
| 2,272,108 | 2/1942 | Bradley | 263/19 |
| 4,463,799 | 8/1984 | Takahashi et al. | 165/10 |
| 4,943,317 | 7/1990 | Lischka et al. | 75/312 |
| 4,991,396 | 2/1991 | Goerlich et al. | 431/354 |

FOREIGN PATENT DOCUMENTS

| | | | |
|---|---|---|---|
| 0373450 | 6/1990 | European Pat. Off. . | |
| 4108744 | 8/1992 | Germany . | |
| 47-14243 | 4/1972 | Japan | 165/9.4 |
| 387070 | 2/1933 | United Kingdom | 165/9.4 |

*Primary Examiner*—John Rivell
*Assistant Examiner*—Christopher Atkinson
*Attorney, Agent, or Firm*—Young & Thompson

[57] ABSTRACT

A method is provided for heating a gas in a regenerator with a heat accumulation mass consisting of a loose bulk material arranged in a ring between two coaxial cylindrical grids, a hot collection chamber, surrounded by the inner hot grid, for the hot gases and a cold collection chamber, enclosed between the outer cold grid, on the one hand, and the wall of the regenerator, on the other hand, for the cold gases, wherein the increase in the head loss during the heating phase is at least 5 times as great as the product ρ.g.H, in which H is the height of the regenerator, ρ is the density of the gas at a temperature of 20° C. and g is the acceleration due to gravity, and the gas flow rate is at least equal to 300 $m^3N/h.m^2$ of surface area of the hot grid at standard pressure.

4 Claims, 2 Drawing Sheets

METHOD FOR HEATING A GAS IN A REGENERATOR

FIELD OF THE INVENTION

The present invention relates to a method for heating a gas in a regenerator with a heat accumulation mass consisting of a loose bulk material arranged in a ring between two coaxial cylindrical grids, a hot collection chamber, surrounded by the inner hot grid, for the hot gases and a cold collection chamber, enclosed between the outer cold grid, on the one hand, and the external wall of the regenerator, on the other hand, for the cold gases, as well as a regenerator of this type.

BACKGROUND OF THE INVENTION

In such a regenerator, the hot gases and cold gases are respectively conveyed radially through the heat accumulation mass, in contrast to air heaters which are otherwise usual, and actually during the heating phase, from the hot collection chamber inside the regenerator to the outer cold collection chamber, and in the opposite direction during the cold blowing of the regenerator. The gases to be heated may also be gaseous mixtures, which also contain proportions of vapors, in particular water vapor.

A regenerator of this type is described in U.S. Pat. No. 2,272,108. The quantitative embodiment, not given here, of the example of application which is given therein shows that a regenerator according to the description of this U.S. Patent would absolutely not operate in practice. A qualitative evaluation furthermore demonstrates that the gas speed chosen for passing through the heat accumulation layer was chosen much too small and furthermore that the aforementioned size of the particles of the loose bulk material of the heat accumulation mass is too large. These values thus lead to a head loss of the gas which is too small in the material bed. Thus, the pressure of the gas decreases with the height in the cold collection chamber, while this effect, also known by the term "stack effect", is negligible in the cold collection chamber. In the application example, the pressure difference caused by this "stack effect" is a multiple of the head loss in the material bed, with the consequence that, when heating the regenerator, the heating gases flow only in the upper region through the material bed while, in the lower region, back-flow might even be expected. When working under hot blast, and therefore during the cold blowing, the conditions are reversed, that is to say that only the lower region of the material bed would be exposed. These results necessarily lead to the conclusion that the regenerator described in U.S. Pat. No. 2,272,108 would fail entirely.

SUMMARY OF THE INVENTION

The object of the invention is therefore to improve the method mentioned in the introduction, as well as the regenerator described hereinabove, by avoiding the drawbacks generated by the stack effect and in particular by increasing the power of the regenerator, but with a constructional height of the latter which is markedly reduced.

In the scope of the method described hereinabove, this object is achieved by the fact that the increase in the head loss during the heating phase is at least 5 times as great as the product ρ.g.H, in which H is the height of the regenerator, ρ is the density of the gas at a temperature of 20° C. and g is the acceleration due to gravity, and that the gas flow rate is at least equal to 300 $m^3N/h.m^2$ of surface area of the hot grid at standard pressure.

DETAILED DESCRIPTION OF THE INVENTION

Figure 1:
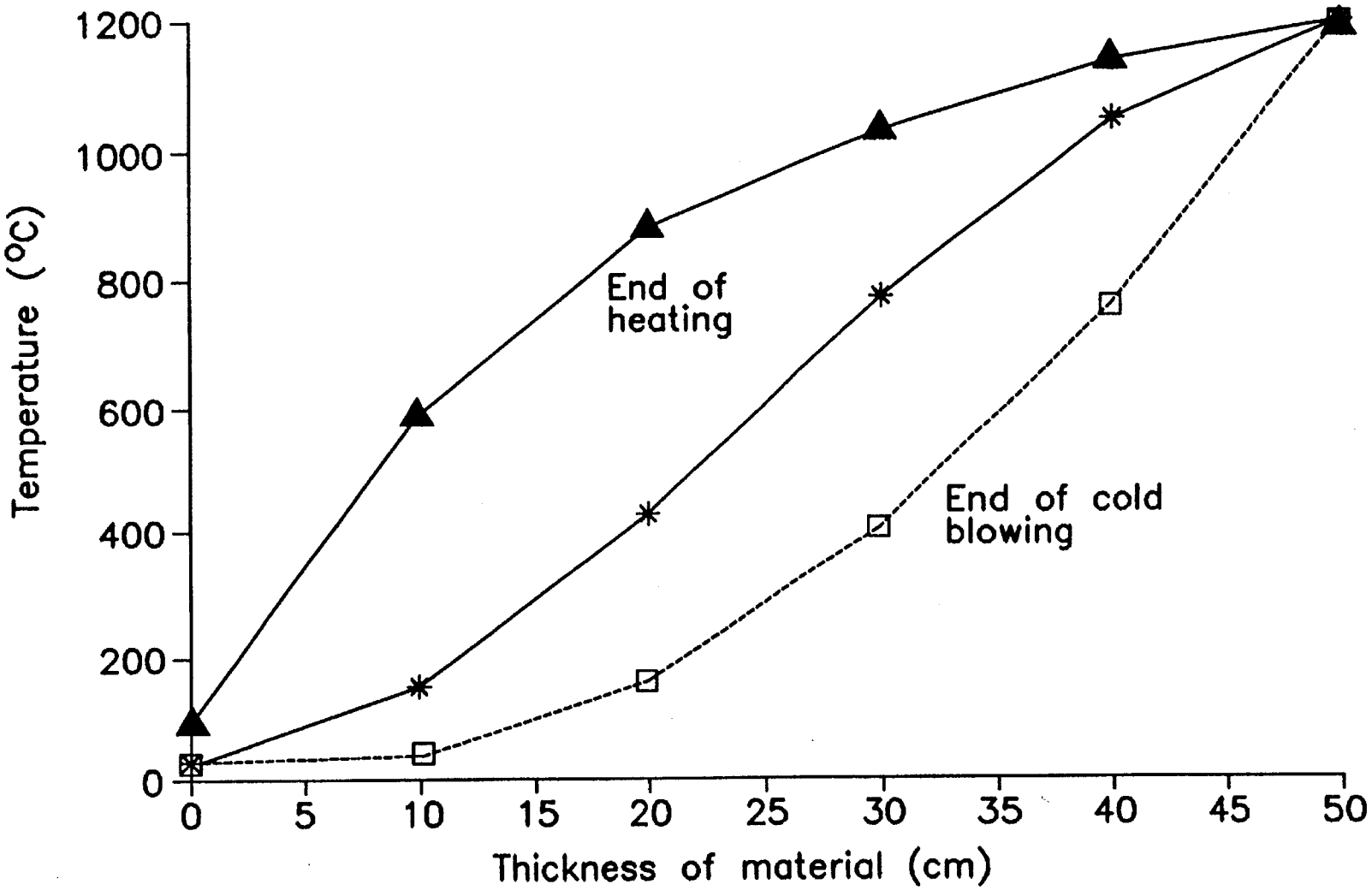
FIG. 1 is a graphical representation of the temperature distribution.

Implementation of the method according to the invention has shown that, in contrast to known air heaters, an entirely different temperature distribution is established in the loose bulk material, because it is essentially linear in these known air heaters, while, in the method proposed, it is in contrast of S shape. This S distribution of the temperature, shown in FIG. 1, first has the advantage that the temperature drop of the hot blast during the cold blowing is very small, and furthermore that the variation in the average temperature of the entire material bed is, in contrast, very high, at approximately 600° C. In hitherto known air heaters, the variation in the average temperature is, in contrast, only equal to approximately 100° C. which results in the S distribution of the temperature storing approximately six times more heat energy than the linear temperature distribution. This result makes it possible to reduce the heat accumulation mass to approximately one sixth.

This solution also leads to the stack effect described hereinabove becoming weaker and even being eliminated. It is advantageous for the difference $\Delta^{2p}$ constituted by $\Delta P_{hot}$ (pressure drop of the regenerator at the end of the heating phase) and $\Delta P_{cold}$ (pressure drop of the regenerator at the start of the heating phase) to be large compared to ρ.g.H. Quantitatively, it is advantageous to try to satisfy $$\frac{\Delta^{2p}}{\rho \cdot g \cdot H} = 10 \text{ to } 20.$$

In an advantageous embodiment of the method, the cold phase, that is to say the cold blowing, is carried out with an overpressure.

In this form of operation, necessary for example during the application of the method to heating a blast furnace blast, the flow rate of gas to be heated increases in the ratio $P/P_0$, without the heat transfer being adversely affected. If a blast furnace blast is produced, for example, under a pressure of 5 bar, the flow rate may reach 5000 $m^3N/h.m^2$, or 2500 $kW/m^2$. With a regenerator having a grid surface area of 20 $m^2$, a hot blast flow rate of 100,000 $m^3N/h$ may be produced.

The heating of the heat accumulation mass will, on the other hand, only be carried out at normal pressure, for economic reasons, and for this reason three regenerators must be heated simultaneously, while a fourth regenerator is undergoing cold blowing.

Advantageously, the particle size of the loose bulk material is chosen to be less than 15 mm.

In another advantageous embodiment of the method, when operating with partial load, the heating phase is carried out at full power and pauses are made after the cold blowing phase.

This embodiment of the method makes it possible to work with the desired throttled power, and the thermal equilibrium of the two phases is then set up by the pauses after the cold blowing, and also to use, for heating the regenerator, a burner which has only a very limited setting range, in contrast to the burners hitherto used in conventional blast heaters.

The other object imposed on the invention is, in a regenerator intended for implementing the method, achieved by the fact that the external diameter of the annular heat accumulation mass is at most double the internal diameter.

This embodiment of the thickness of the heat accumulation layer influences the parameter $\Delta^{2p}$ already explained hereinabove. This parameter is in fact small for a diameter ratio greater than that mentioned. Calculations and tests have shown that this ratio should not substantially exceed the value 2.

Advantageously, the regenerator is heated with a premix burner.

The use of such a burner guarantees that the hot collection chamber of the regenerator entirely suffices as a combustion chamber and that the combustion takes place not only smoothly but also without pulsation. Furthermore, the size of the regenerator is not unfavorably influenced by the use of such a premix burner.

Figure 2:
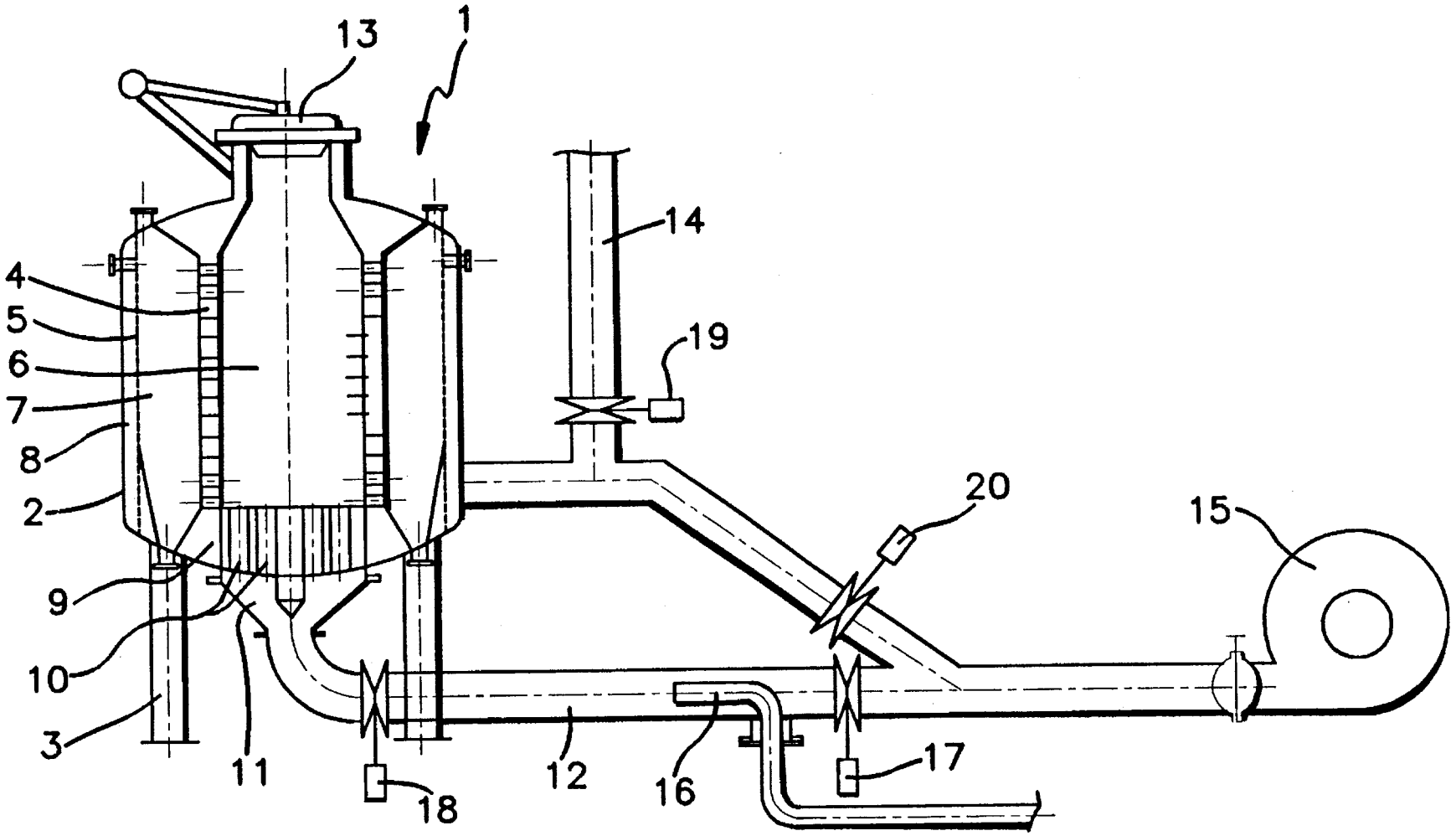
FIG. 2 is a regenerator apparatus suitable to carry out the invention.

One embodiment of the burner is represented in FIG. 2 and will be explained in detail hereinbelow.

The regenerator 1 intended for implementing the method of the invention has an enclosure 2 with the form of an upright cylinder, which may, for example, be supported using pillars 3.

The internal space of the enclosure 2 is essentially divided, by two grids 4 and 5 of cylindrical shape and arranged concentrically at a distance from each other, into an inner cylindrical hot collection chamber 6, an intermediate annular chamber 7 containing the heat accumulation mass consisting of loose bulk material, and a cold outer annular collection chamber 8 formed by the wall of the enclosure 2 with the grid 5.

In the masonry base region 9 of the enclosure 2, inlets 10 have been provided for the heating gases which are produced by a premix burner 11, which is in turn fed by a gas/air mixing tube 12.

The hot inner collection chamber 6 ends, in the upper region of the enclosure 2 of the regenerator 1, in a hot blast outlet 13; the outer collection chamber 8 is connected to a chimney 14 for removing the burnt gases, from which the heating gases can escape after they have been passed through the heat accumulation agent in the intermediate chamber 7.

The gas/air mixing tube 12 is connected to a fan 15 which produces air both for the heating phase and for the cold blowing phase. In the heating phase, the air is conveyed by the gas/air mixing tube 12 and mixed with the heating gas, which has been introduced by the gas injector 16 into the gas/air mixing tube 12.

After completion of the heating phase, the valves 17, 18 and 19 are closed, while the valve 20 as well as the outlet 13 are, in contrast, opened, so that the cold blowing phase can then start. After completion of the cold blowing phase, the open connectors are again closed and the previously closed valves are opened, so that the heating phase can restart.

The loose bulk material of the heat accumulation mass is composed of a charge of granules with a particle size which does not exceed 15 mm, and the external diameter of the annular heat accumulation mass is not greater than double the internal diameter.

Although the heat accumulation mass of this regenerator is reduced to approximately one sixth of the heat accumulation mass of normal air heaters, having vertical circulation, which were hitherto used, the same quantity of heat energy is accumulated; this results from the S distribution of the temperature, according to FIG. 1. This temperature distribution is fundamentally different from that of known air heaters, in which it is essentially linear. The S distribution of the temperature provides two conclusive advantages compared to the linear distribution: on the one hand the temperature drop of the hot blast during the cold blowing phase is very small, and, on the other hand, the variation in the average temperature of the entire material bed is very high, of the order of 600° C. The S distribution of the temperature also depends, however, not only on the prescribed particle size of the charge of granules but also on the minimum determined gas flow rate. This minimum flow rate corresponds to a power of 300 $m^3N/h.m^2$. This corresponds, for a blast temperature of 1200° C. to a specific power of 150 $kW/m^2$, which must not be fallen below. When the power increases, the S profile of the temperature becomes increasingly pronounced. A particularly advantageous operating point appears for a flow capacity of 1000 $m^3N/h.m^2$, a head loss of 1000 to 1600 pascal. An increase in the flow rate up to 2000 $m^3N/h.m^2$ is possible without decreasing the heat transfer, considering a head loss of 3000 to 5000 pascal. This power limit is applicable to running under normal pressure.

Operation under increased pressure has demonstrated the surprising result that the flow rate can be further increased, virtually proportionately to the absolute pressure, without the heat transfer data being adversely affected. If, for example, a blast furnace blast is produced at 5 bar, the flow rate may reach 5000 $m^3N/h.m^2$, or 2500 $kW/m^2$. A hot blast flow rate of 100,000 $m^3N/h$ can thus be produced with a regenerator having a grid surface area of 20 $m^2$.

Because the heating of the regenerator is, in fact, generally carried out at normal pressure, three generators must be heated simultaneously, so that four regenerators are necessary in total in order to ensure continuous operation with a view to producing hot gases. These regenerators have a diameter of only 4 m with a height of 5 m, whereas air heaters of the same power, hitherto used, have a diameter of 8 m and a height of 30 m.

Operation under partial load is, in fact, achievable only by carrying out the heating phase at full power, but it may, however, be necessary to insert pauses after the cold blowing phase. This results from the fact that, because of the small size of the regenerator, the use of a normal burner for heating the regenerator is not possible, because such a burner has a larger constructional volume than the regenerator itself. A so-called premix burner is thus used, in which the heating gas and the combustion air are intimately mixed with each other when cold, before ignition, and are burnt only after they have been mixed. For reliable operation of such a premix burner, it is necessary not to fall below a minimum speed of the gases, in order thus to reliably prevent flashback of the mixture. This results in such a premix burner having only a very limited setting range.

The pauses which are thus necessary for operation under partial head are preferably made after the cold blowing of the regenerator.

Finally, it was further observed during the operation of such a regenerator that the temperature of the hot blast lay only 20° C. below the theoretical flame temperature, and that it remained largely constant throughout the blast phase. This indicates that, even in the case of a temperature drop, an improvement by a factor of 10 was achieved, exactly as in the case of the size. The thermal efficiency was raised from 65% for conventional air heaters to 95% for the regenerator according to the invention.

I claim:

1. Method for heating a gas and reducing stack effects in a regenerator with a heat accumulation mass consisting of a loose bulk material arranged in a ring between an inner cylindrical grid and an outer coaxial cylindrical grid, a hot collection chamber, surrounded by the inner grid, for hot gases and a cold collection chamber, enclosed between the outer grid and an external wall of the regenerator, for cold gases, comprising:

a) during a heating phase, conveying a heating gas from the hot collection chamber to the cold collection chamber, through the heat accumulation mass;

b) during a blowing phase, conveying said gas to be heated from the cold collection chamber to the hot collection chamber, through the heat accumulation mass;

wherein $\Delta P$ hot$-\Delta P$ cold$\geqq 5\ \rho gH$ where $\Delta P$ hot represents the pressure drop of the regenerator at the end of the heating phase, $\Delta P$ cold represents the pressure drop of the regenerator at the start of the heating phase, H is the height of the regenerator, $\rho$ is the density of said gas to be heated at 20° C., g is the acceleration due to gravity, and wherein a flow rate of the said gas to be heated during the heating phase is at least equal to 300 $m^3N/h.m^2$ of surface area of the inner grid at standard pressure.

2. Method according to claim 1, wherein the blowing phase is carried out with an overpressure.

3. Method according to claim 1, wherein the loose bulk material has a particle size of less than 15 mm.

4. Method according to claim 1, wherein when operating with partial load, the heating phase is carried out at full power and pauses are made after the blowing phase.

* * * * *